US008853597B2

(12) United States Patent
Chin

(10) Patent No.: US 8,853,597 B2
(45) Date of Patent: Oct. 7, 2014

(54) HEAT SPREADING/TEMPERATURE UNIFORMITY DEVICE FOR A BAKE OVEN

(76) Inventor: Chuan-Fu Chin, Sanxia Township, Taipei County (TW)

( * ) Notice: Subject to any disclaimer, the term of this patent is extended or adjusted under 35 U.S.C. 154(b) by 535 days.

(21) Appl. No.: 12/882,527

(22) Filed: Sep. 15, 2010

(65) Prior Publication Data

US 2011/0253700 A1 Oct. 20, 2011

(30) Foreign Application Priority Data

Apr. 15, 2010 (TW) ..... 99111746 A
Apr. 29, 2010 (CN) ..... 2010 2 0176306 U

(51) Int. Cl.
*F27D 11/00* (2006.01)
*F24C 7/06* (2006.01)
*F24C 15/24* (2006.01)

(52) U.S. Cl.
CPC .. *F24C 15/24* (2013.01); *F24C 7/06* (2013.01)
USPC ..... 219/395; 219/401

(58) Field of Classification Search
USPC ..... 219/395, 399, 401; 126/337, 333, 505, 126/506
See application file for complete search history.

(56) References Cited

U.S. PATENT DOCUMENTS 4,989,748 A * 2/1991 Parr et al. ..... 220/368
6,067,981 A * 5/2000 Peter et al. ..... 126/337 R
2005/0121434 A1* 6/2005 Kim ..... 219/401

* cited by examiner

*Primary Examiner* — Henry Yuen
*Assistant Examiner* — Phuong Nguyen
(74) *Attorney, Agent, or Firm* — Jackson IPG PLLC

(57) ABSTRACT

A heat spreading/temperature uniformity device for a bake oven is disclosed. The heat spreading/temperature uniformity device is applicable to the bake oven, including at least one rack body movably disposed in a receiving space defined by the bake oven, and multiple heat spreading members distributed over and arranged on the rack body and integrally connected therewith. Each heat spreading member and the rack body contain a first angle and a second angle. The heat spreading/temperature uniformity device is up and down adjustably disposed in the bake oven for transferring heat to the relatively low heating intensity areas of the receiving space in the form of heat radiation. Accordingly, the food placed in the bake oven can be uniformly heated at a uniform heating intensity and a uniform temperature.

6 Claims, 8 Drawing Sheets

HEAT SPREADING/TEMPERATURE UNIFORMITY DEVICE FOR A BAKE OVEN

This application claims the priority benefits of Taiwan patent application number 099111746 filed on Apr. 15, 2010 and China patent application number 201020176306.X filed on Apr. 29, 2010.

FIELD OF THE INVENTION

The present invention relates to a heat spreading/temperature uniformity device for a bake oven. The heat spreading/temperature uniformity device is able to transfer heat to the relatively low heating intensity areas of the bake oven in the form of heat radiation to uniformly heat the food placed in the bake oven.

BACKGROUND OF THE INVENTION

In modern life, a bake oven is a helpful and inevitable domestic electrical apparatus for cooking foods. The bake oven can be conveniently used to bake breads, cookies, chickens, meats, etc.

In a conventional bake oven, multiple electrical heating tubes are generally installed in an upper side or a lower side of the interior space of the bake oven. After powered on, the heating tubes generate heat to heat and bake the food placed in the bake oven with a large area. In the baking process, it often takes place that the large-area food cannot be uniformly heated. The bake oven defines a closed space and is generally equipped with a fan for transferring heat by forced convection. In case of a bake oven without any fan, the left and right sides of the interior space of the bake oven and the edges of the door of the bake oven will become the blind corners of the bake oven with weaker heating intensity. As a result, the large-area food can be hardly fully uniformly heated to affect the appearance and taste of the food or even threaten food safety.

For uniformly baking the large-area food at a uniform heating intensity, a user needs to irregularly open the door of the bake oven to turn over the food. Each time the user opens the door of the bake oven, the heat intensity in the bake oven is decreased and the temperature in the bake oven will rise only after the door of the bake oven is re-closed. This leads to waste of energy. Moreover, when a user turns over the food in the bake oven with one hand, the user's hand is likely to incautiously get burnt. Therefore, the baking process is complicated and time-consuming. Furthermore, it is quite inconvenient and unsafe to use the conventional bake oven. According to the aforesaid, the conventional bake oven has the following shortcomings:

1. The conventional bake oven cannot provide a uniform heating intensity to bake the food at a uniform temperature.
2. It is time-consuming to use the conventional bake oven to bake the food.
3. It is inconvenient to use the conventional bake oven to bake the food.
4. The conventional bake oven cannot uniformly heat the food.

SUMMARY OF THE INVENTION

A primary object of the present invention is to provide a heat spreading/temperature uniformity device applicable to a bake oven. The heat spreading/temperature uniformity device includes at least one rack body movably and multiple heat spreading members distributed over and arranged on the rack body and integrally connected therewith. The heat spreading/temperature uniformity device is up and down adjustably disposed in the bake oven for spreading heat over the interior space of the bake oven in the form of heat radiation. Accordingly, the food placed in the bake oven can be uniformly heated at a uniform heating intensity and a uniform temperature.

To achieve the above and other objects, the heat spreading/temperature uniformity device of the present invention is applicable to a bake oven. The heat spreading/temperature uniformity device includes at least one rack body movably disposed in a receiving space defined by the bake oven, and multiple heat spreading members distributed over and arranged on the rack body and integrally connected therewith. Each heat spreading member and the rack body contain a first angle and a second angle. The heat spreading/temperature uniformity device is up and down adjustably disposed in the bake oven for transferring heat to the relatively low heating intensity areas of the receiving space in the form of heat radiation. Accordingly, the food placed in the bake oven can be uniformly heated at a uniform heating intensity and a uniform temperature.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
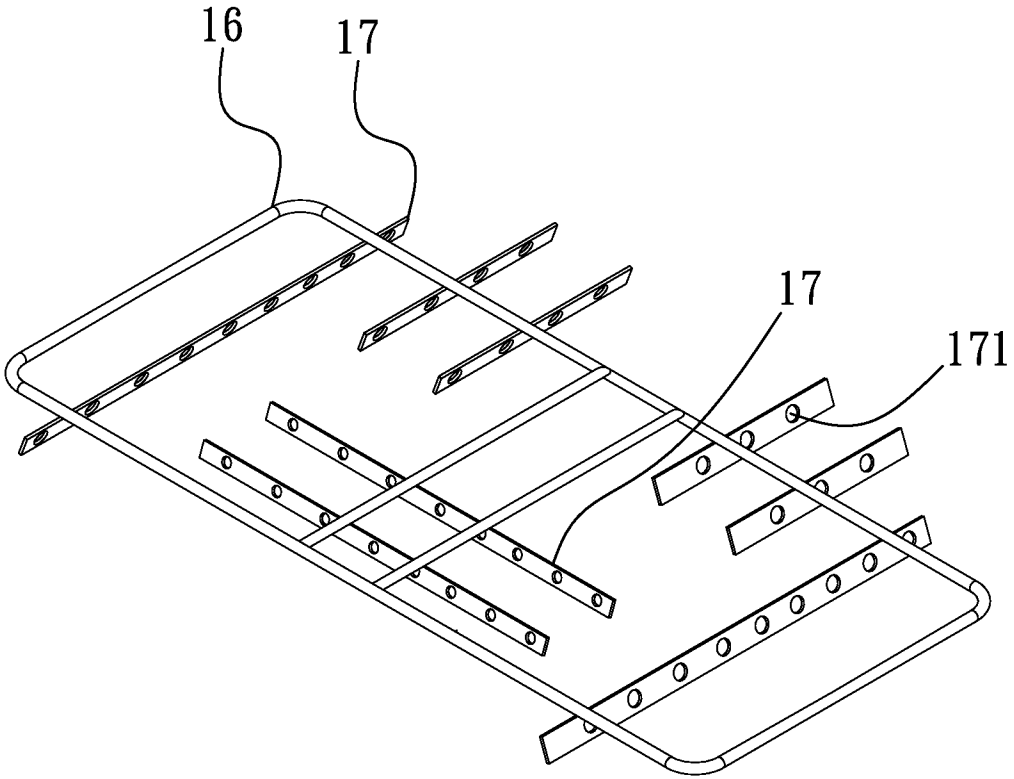
FIG. 1 is a perspective view of a first embodiment of the present invention, showing the rack body and the heat spreading members.
Figure 4:
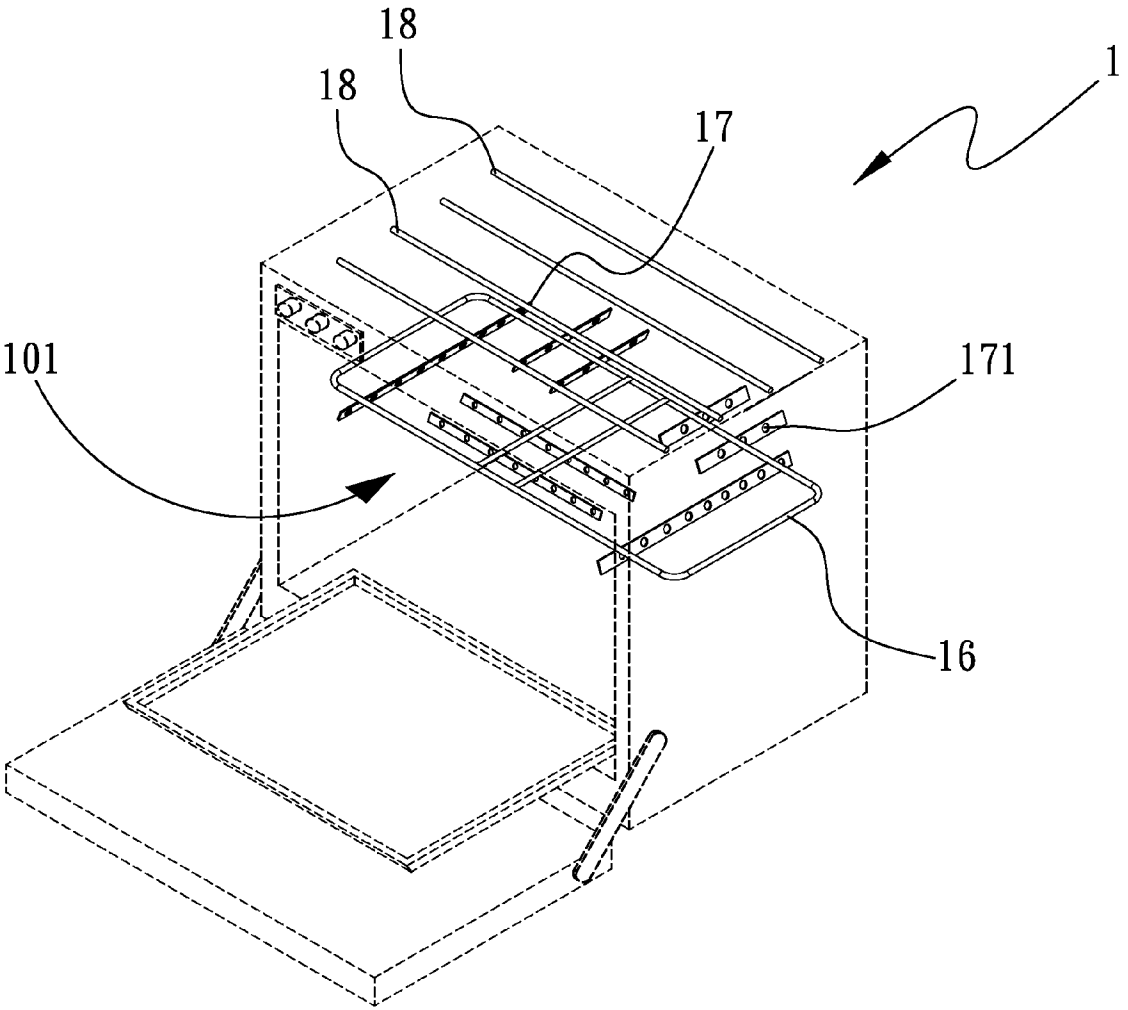
FIG. 4 is a perspective view of the first embodiment of the present invention, showing the application thereof to a bake oven.

Please refer to FIGS. 1 and 4. According to a first embodiment, the heat spreading/temperature uniformity device of the present invention is applied to a bake oven 1. The heat spreading/temperature uniformity device includes at least one rack body 16 and multiple heat spreading members 17. The rack body 16 is made of metal material such as iron, copper and aluminum. The rack body 16 is movably disposed in a receiving space 101 defined by the bake oven 1. The position of the rack body 16 in the receiving space 101 is up and down adjustable according to the volume and size of the food placed in the bake oven 1.

Figure 2:
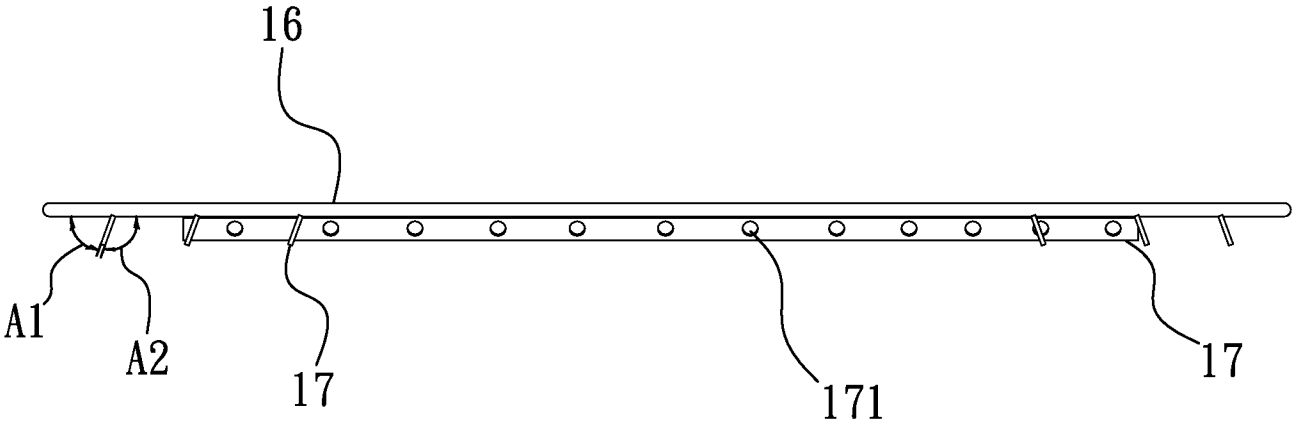
FIG. 2, 2A, and 2B are rear views of variations the first embodiment of the present invention, showing the rack body and the heat spreading members in a first aspect.
Figure 2A:
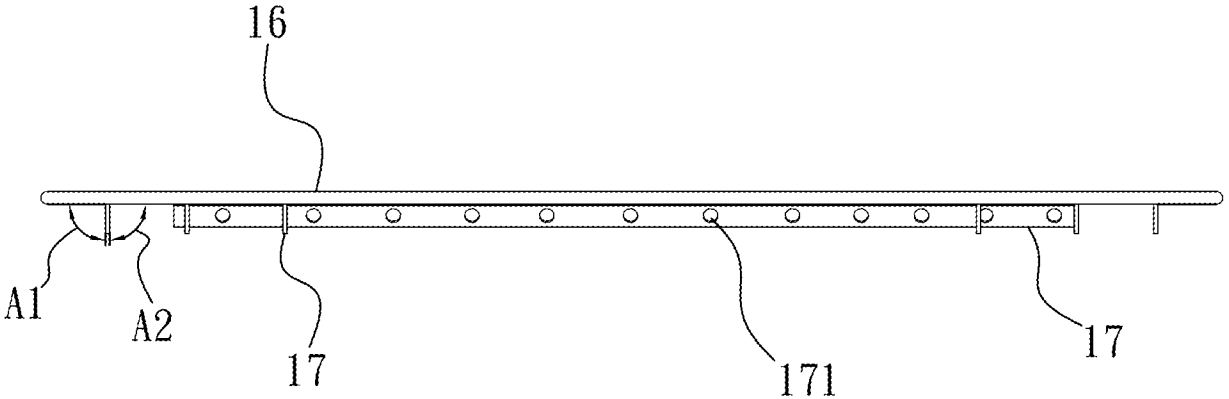
Figure 2B:
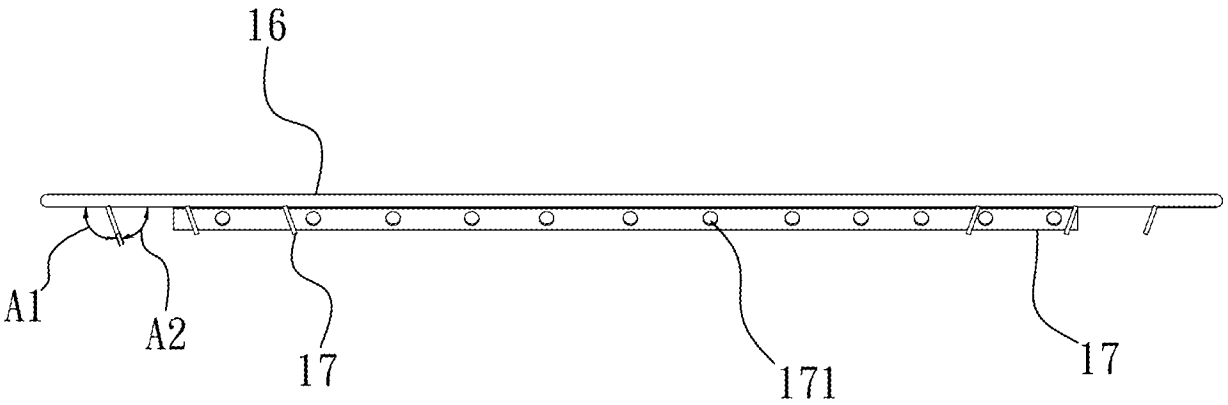

The heat spreading members 17 are distributed over and arranged on the rack body 16 and integrally connected therewith. To speak more specifically, the heat spreading members 17 are configured as elongate flat members and are disposed on the rack body 16 in an inclined state. Referring to FIG. 2, 2A, and 2B, preferably, the configuration and deployment of the rack body 16 and the heat spreading members 17 are adjustable in accordance with the configuration and position of at least one heating tube 18 installed in the bake oven 1. In this embodiment, the heat spreading members 17 are disposed on the rack body 16 in two aspects as follows:

Referring to FIG. 1, in the first aspect, the rack body 16 is rectangular and the heat spreading members 17 are arranged on the rack body 16 in a substantially U-shaped or double U-shaped pattern. The heat spreading members 17 serve to absorb the heat generated by the heating tube 18 and spread the heat to the entire closed receiving space 101 in the form of heat radiation. Accordingly, after the low-temperature areas in the receiving space 101, (such as the lateral sides of the receiving space 101), receive the heat radiation, the low-temperature areas will be heated to a temperature equal to that of the high-temperature areas.

Figure 3:
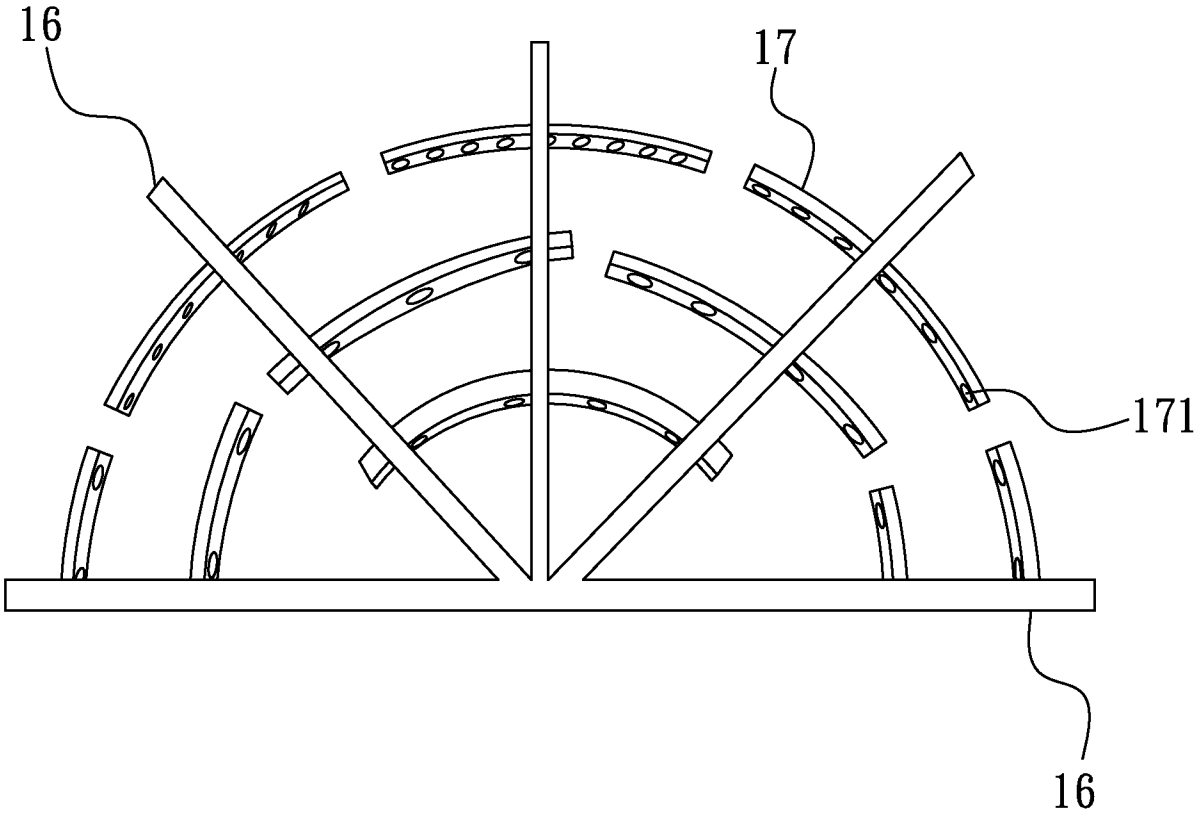
FIG. 3 is a top view of the first embodiment of the present invention, showing the rack body and the heat spreading members in a second aspect.

Please refer to FIG. 3. In the second aspect, the rack body 16 is sector-shaped and the heat spreading members 17 are arranged on the rack body 16 in a sector-shaped pattern. The second aspect can achieve the same effect as the first aspect and thus will not be repeatedly described hereinafter. In practice, the configuration and the deployment of the rack body 16 and the heat spreading members 17 are not limited to the above two aspects. Alternatively, the rack body 16 and the heat spreading members 17 can be arranged in an arcuate pattern, a semicircular pattern or an irregular pattern.

Please refer to FIGS. 2, 2A, 2B, and 4. Each heat spreading member 17 and the rack body 16 contain a first angle A1 and a second angle A2. The first angle A1 is contained between a first side of the heat spreading member 17 and the rack body 16, while the second angle A2 is contained between a second side of the heat spreading member 17 and the rack body 16 opposite to the first side of the heat spreading member 17.

The sizes of the first angle A1 and the second angle A2 can be adjusted in accordance with the preset baking temperature of the bake oven. That is, the size of the first angle A1 can be smaller than, equal to or larger than the size of the second angle A2 to reach a desired baking temperature.

Each of the heat spreading members 17 is formed with multiple perforations 171 in communication with the receiving space 101. The perforations 171 are regularly or irregularly arranged on the heat spreading member 17. The perforations 171 serve to uniformly spread the heat of the heat spreading member 17 to every part of the receiving space 101 in the bake oven 1 to provide uniformity in baking temperature of the bake oven 1.

According to the above arrangement, the heat spreading members 17 disposed on the rack body 16 are able to uniformly spread the heat over the receiving space 101 of the bake oven 1, whereby the food placed in the receiving space 101 can be conveniently and uniformly heated to save baking time. In contrast, in the conventional bake oven, the food can be hardly uniformly heated and it is necessary to irregularly turn the food. This is time-consuming and inconvenient in use of the bake oven.

Figure 5:
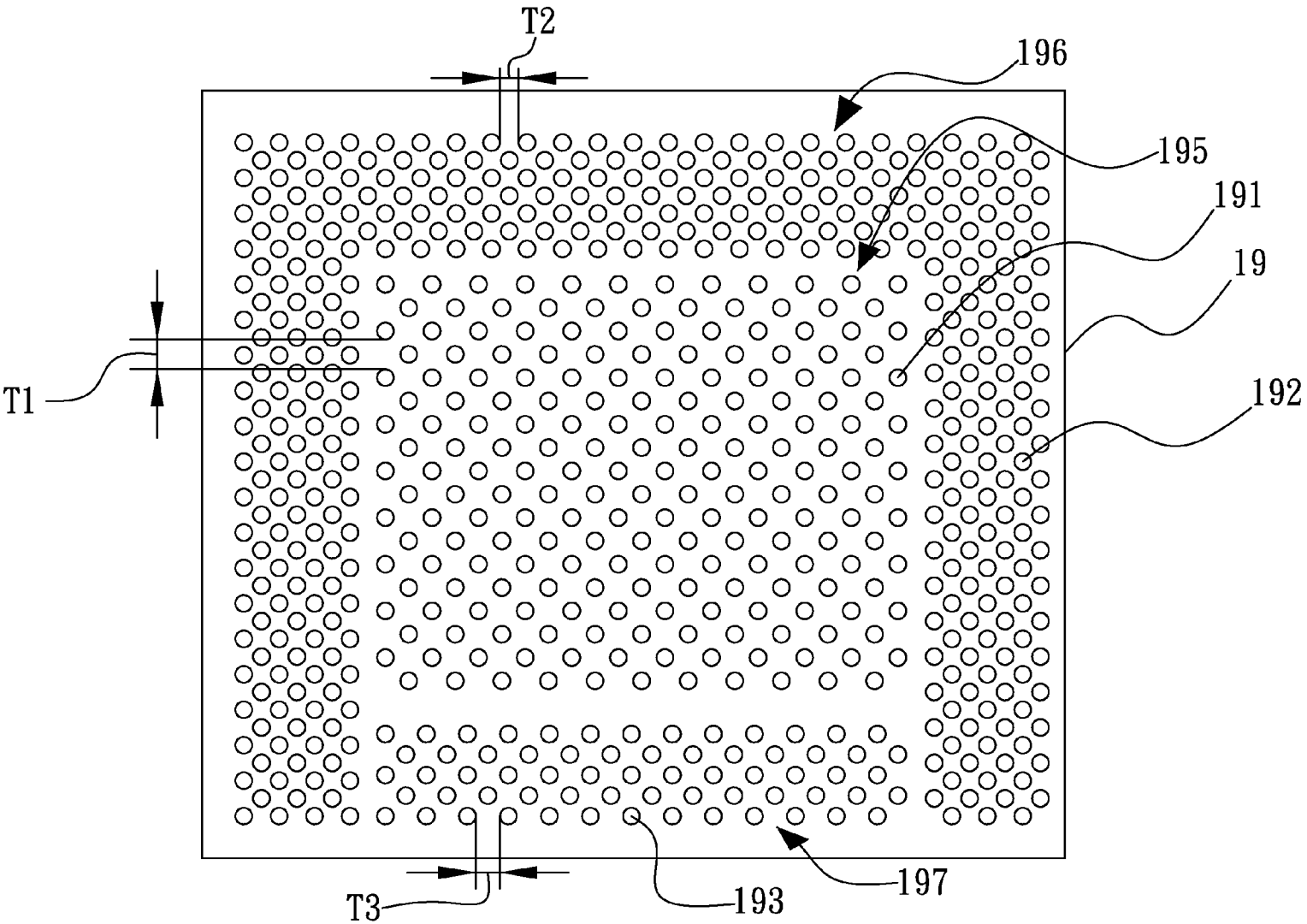
FIG. 5 is a top view of a board body of a second embodiment of the present invention.

Please now refer to FIG. 5, which shows a second embodiment of the present invention. The second embodiment is substantially identical to the first embodiment in structure, connection relationship and function and thus will not be repeatedly described hereinafter. The second embodiment is only different from the first embodiment in that the heat spreading/temperature uniformity device further includes a board body 19 made of metal material such as iron, copper and aluminum. The board body 19 is fixedly disposed in the receiving space 101 opposite to the rack body 16. In this embodiment, the heating tubes 18 are respectively arranged in the top and the bottom of the receiving space 101. The board body 19 is positioned above the heating tubes 18 arranged in the bottom of the receiving space 101. Preferably, for illustration purposes only, the rack body 16 is positioned under the heating tubes 18 arranged in the top of the receiving space 101.

The board body 19 is formed with multiple first through holes 191, multiple second through holes 192 and multiple third through holes 193 in communication with the receiving space 101. By means of the through holes 191, 192, 193, the heat absorbed by the board body 19, (that is, the heat generated by the heating tubes arranged in the bottom of the receiving space), is uniformly spread over the bottom of the receiving space 101 to provide uniformity in baking temperature of the bake oven 1.

Figure 6:
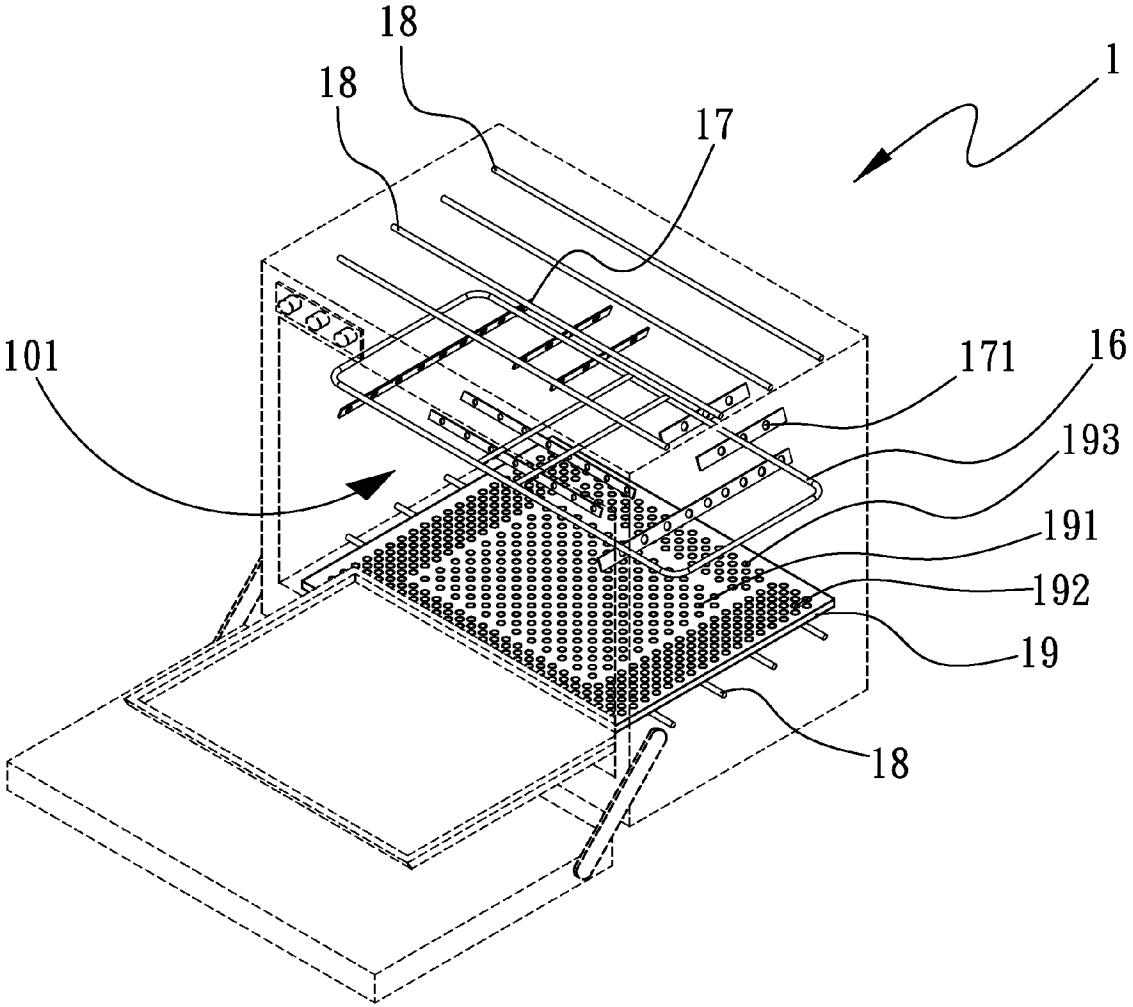
FIG. 6 is a perspective view of the second embodiment of the present invention, showing the application thereof to a bake oven.

Please refer to FIG. 5 as well as FIG. 6. The board body 19 has a first spreading section 195, a second spreading section 196 and a third spreading section 197. The first spreading section 195 is positioned at the center of the board body 19. The first through holes 191 are arranged on the first spreading section 195 at first intervals T1.

The second spreading section 196 is positioned around the first spreading section 195. The second through holes 192 are arranged on the second spreading section 196 at second intervals T2. The third spreading section 197 is positioned between two ends of the second spreading section 196 in adjacency to the first spreading section 195. The third through holes 193 are arranged on the third spreading section 197 at third intervals T3.

The first, second and third intervals T1, T2, T3 can be adjusted in accordance with the preset baking temperature and heating intensity of the bake oven. To speak more specifically, the first intervals T1 between the first through holes 191 can be first adjusted and then the second intervals T2 between the second through holes 192 can be adjusted and finally the third intervals T3 between the third through holes 193 can be adjusted. That is, the first intervals T1 are larger than the second and third intervals T2, T3. The third intervals T3 are larger than the second intervals T2. Accordingly, the first, second and third intervals T1, T2, T3 can be adjusted to provide a desired heating intensity to reach the necessary baking temperature.

According to the above arrangement, the heat spreading members 17 arranged on the rack body 16 with the perforations 171 and the board body 19 with the first, second and third through holes 191, 192, 193 are able to uniformly spread the heat generated by the heating tubes 18 disposed in the top and the bottom of the receiving space 101 over the receiving space 101 in the bake oven 1. Therefore, after the low-temperature areas in the receiving space 101, (such as the lateral sides of the receiving space 101), receive the heat radiation, the low-temperature areas will be heated to a temperature equal to that of the high-temperature areas. In this case, the food placed in the receiving space 101 can be uniformly heated at a uniform heating intensity and a uniform temperature to save baking time.

In conclusion, the present invention has the following advantages over the prior art:

1. The present invention is able to uniformly spread the heat over the receiving space of the bake oven to provide a uniform heating intensity.
2. The bake oven with the present invention can be more conveniently used.
3. The food placed in the bake oven can be more uniformly heated to save baking time.

The above embodiments are only used to illustrate the present invention, not intended to limit the scope thereof. It is understood that many changes and modifications of the above embodiments can be made without departing from the spirit of the present invention. The scope of the present invention is limited only by the appended claims.

What is claimed is:

1. A heat spreading/temperature uniformity device for a bake oven, the heat spreading/temperature uniformity device being applicable to the bake oven, comprising:

at least one rack body movably disposed in a receiving space defined by the bake oven; and multiple heat spreading members configured as elongate flat members distributed over and arranged on the rack body in an inclined state and integrally connected therewith, wherein a first inclined side of each heat spreading member and the rack body containing a first angle and a second opposite inclined side of each heat spreading member and the rack body defined a second angle, wherein the first and second angles are adjustable so as to change a direction of heat radiation and wherein each heat spreading member is formed with multiple perforations in communication with the receiving space so as to uniformly spread heat to the receiving space via heat radiation;

wherein the multiple heat spreading members are arranged on the rack body in a substantially double U-shaped pattern;

wherein the multiple rack body is sector-shaped and the heat spreading members are arranged on the rack body in a sector-shaped pattern.

2. The heat spreading/temperature uniformity device for the bake oven as claimed in claim 1, wherein the perforations are regularly or irregularly arranged on the heat spreading member.

3. The heat spreading/temperature uniformity device for the bake oven as claimed in claim 1, wherein the first angle has a size smaller than that of the second angle.

4. The heat spreading/temperature uniformity device for the bake oven as claimed in claim 1, wherein the first angle has a size equal to that of the second angle.

5. The heat spreading/temperature uniformity device for the bake oven as claimed in claim 1, wherein the first angle has a size larger than that of the second angle.

6. The heat spreading/temperature uniformity device for the bake oven of claim 1, wherein the at least one rack body is up and down adjusting in the receiving space.

* * * * *